US009845932B2

(12) United States Patent
Bauer et al.

(10) Patent No.: US 9,845,932 B2
(45) Date of Patent: Dec. 19, 2017

(54) OPTICAL ELEMENT FOR A LASER VEHICLE HEADLIGHT

(71) Applicant: ZIZALA LICHTSYSTEME GMBH, Wieselburg (AT)

(72) Inventors: Friedrich Bauer, Bergland (AT); Andreas Moser, Haag (AT); Johann Altmann, Gmünd (AT); Erich Kaufmann, Linz (AT)

(73) Assignee: ZKW GROUP GMBH, Wieselburg an der Erlauf (AT)

( * ) Notice: Subject to any disclaimer, the term of this patent is extended or adjusted under 35 U.S.C. 154(b) by 688 days.

(21) Appl. No.: 14/382,567

(22) PCT Filed: Feb. 28, 2013

(86) PCT No.: PCT/AT2013/050048
§ 371 (c)(1),
(2) Date: Sep. 3, 2014

(87) PCT Pub. No.: WO2013/134802
PCT Pub. Date: Sep. 19, 2013

(65) Prior Publication Data

US 2015/0049501 A1 Feb. 19, 2015

(30) Foreign Application Priority Data

Mar. 12, 2012 (AT) ..... A 50072/2012

(51) Int. Cl.
*F21V 11/00* (2015.01)
*F21S 8/10* (2006.01)

(52) U.S. Cl.
CPC ..... *F21S 48/13* (2013.01); *F21S 48/1109* (2013.01); *F21S 48/1145* (2013.01); *F21S 48/12* (2013.01);
(Continued)

(58) Field of Classification Search
CPC .... F21S 48/1109; F21S 48/1145; F21S 48/12; F21S 48/1225; F21S 48/1241;
(Continued)

(56) References Cited

U.S. PATENT DOCUMENTS

2005/0105301 A1* 5/2005 Takeda ..... F21S 48/1154 362/545
2008/0225544 A1* 9/2008 Fujiwara ..... B60Q 1/0041 362/538
(Continued)

FOREIGN PATENT DOCUMENTS

CN 1456837 A 11/2003
EP 2447600 A2 5/2012
(Continued)

OTHER PUBLICATIONS

Search Report of PCT/AT2013/050048 dated Jun. 18, 2013.
First Office Action of Austrian priority application No. A 50072/2012.

*Primary Examiner* — Bryon T Gyllstrom
(74) *Attorney, Agent, or Firm* — Eversheds Sutherland (US) LLP

(57) ABSTRACT

The invention relates to an optical element (1) for a laser vehicle headlight (2), wherein the laser vehicle headlight (2) comprises at least one laser light source (3) and at least one luminous element (4) which can be irradiated by the laser light source (3) and can thus be excited to emit visible light, wherein the optical element (1) has at least one receptacle for the luminous element (4) and at least one reflection layer (9) which reflects light in the direction of the laser light source (3) is assigned to the optical element (1) at least on a side of the luminous element (4) which faces away from the laser light source (3) in the mounted state. The invention additionally relates to a light source module (16) comprising at least one optical element (1) of this type, and a vehicle
(Continued)

Figure 1:
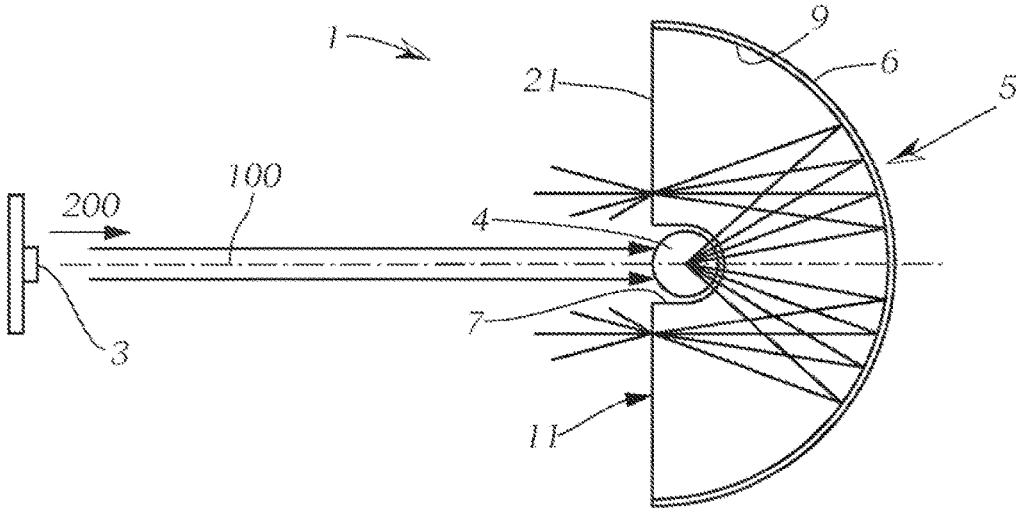

headlight (2) comprising at least one optical element (1) of this type or comprising at least one light source module (16) as mentioned initially.

21 Claims, 3 Drawing Sheets

(52) U.S. Cl.
CPC ..... *F21S 48/1225* (2013.01); *F21S 48/1241* (2013.01); *F21S 48/1329* (2013.01); *F21S 48/1388* (2013.01); *F21S 48/1394* (2013.01); *F21S 48/14* (2013.01); *F21S 48/328* (2013.01)

(58) Field of Classification Search
CPC ..... F21S 48/1329; F21S 48/1388; F21S 48/1394; F21S 48/14; F21S 48/328
USPC ..... 362/510
See application file for complete search history.

(56) References Cited

U.S. PATENT DOCUMENTS

2011/0063115 A1* 3/2011 Kishimoto ..... F21K 9/00 340/600
2011/0194302 A1* 8/2011 Kishimoto ..... F21S 48/1154 362/511
2011/0279007 A1* 11/2011 Kishimoto ..... B60Q 1/0011 313/45
2011/0280033 A1* 11/2011 Kishimoto ..... F21S 48/1145 362/543
2011/0292636 A1 12/2011 Takeda et al.
2012/0106184 A1* 5/2012 Kishimoto ..... B60Q 1/0011 362/510
2012/0106186 A1* 5/2012 Kishimoto ..... C09K 11/0883 362/510
2012/0294023 A1 11/2012 Nakazato
2013/0027962 A1* 1/2013 Takahashi ..... F21S 48/1145 362/538
2014/0347874 A1 11/2014 Nakaya

FOREIGN PATENT DOCUMENTS

EP 2525140 A2 11/2012
EP 2796771 A1 10/2014
JP 2003-295319 A 10/2003
JP 2004241142 A 8/2004
JP 2007173177 A 7/2007
JP 2008-108553 A 5/2008

* cited by examiner

OPTICAL ELEMENT FOR A LASER VEHICLE HEADLIGHT

The invention relates to an optical element for a laser vehicle headlight, wherein the laser vehicle headlight comprises at least one laser light source and at least one luminous element which can be irradiated by the laser light source and can thus be excited to emit visible light. The invention additionally relates to a light source module comprising at least one optical element of this type, and a vehicle headlight comprising at least one optical element of this type or comprising at least one light source module as mentioned initially.

Various types of vehicle headlights are known from the prior art, wherein headlights with discharge lamps and halogen light sources have been used predominantly in recent years. For energy-saving reasons and in order to further reduce the spatial requirement of vehicle headlights, the use of laser light sources such as semiconductor lasers is being increasingly tested, since these are advantageous in this regard. In order to make the laser light usable for a vehicle headlight, a luminous element, or what is known as a phosphor converter, is irradiated by a laser light source and is thus excited to radiate visible light.

By way of example, US 2011/0194302 A1 presents a light source of this type, where a laser diode radiates via a light guiding element from behind onto a luminous element consisting of a fluorescent substance, the luminous element then in turn emitting light that is directed via a reflector shield in the direction of travel.

However, the fluorescent substance also emits the produced visible light directly in the direction of travel without it being possible to optically pre-form the light, which may be advantageous in particular in the case of light exposures that must meet legal requirements.

In addition, the laser light sources currently used emit powers up to 3 W (an increase of the emitted powers should not be ruled out in future) in the main radiation direction of the headlight, and in the case of a malfunction of or damage to the headlight, this may thus lead to injuries as a result of highly intense laser light radiation that is harmful to the eyes, but in any case may lead to the endangerment of other road users.

These problems are confronted in the prior art in different ways: In JP 2003295319 A, a reflective mirror is arranged on the side of the luminous element facing away from the laser light source and reflects back into the luminous element any laser light radiating past the luminous element. An endangerment of other road users by laser radiation is thus prevented.

US 2011/0157865 A1 describes a lighting device in which a concave mirror is arranged in front of the luminous element with fluorescent substance and deflects the light radiated in the forward direction in the direction of the luminous element or in the direction of a main reflector of the lighting device.

A particular disadvantage of these solutions is the fact that separate components have to be manufactured and positioned very precisely, which on the one hand leads to higher costs and on the other hand leads to a greater assembly effort.

The object of the invention is therefore to eliminate the above-mentioned disadvantages of the prior art.

This object is achieved in accordance with the invention with an optical element of the type mentioned in the introduction in that the optical element has at least one receptacle for the luminous element and at least one reflection layer which reflects light in the direction of the laser light source is assigned to the optical element at least on a side of the luminous element which faces away from the laser light source in the mounted state.

The invention enables a compact optical element comprising a luminous element, of which the light can be optically pre-formed by the assigned reflection layer. The reflection layer reflects both visible light and radiated laser light. Since the luminous element and optical pre-forming are combined in one component, a quick, uncomplicated installation in the light source module and/or vehicle headlight is possible. The optical element can be installed easily for this purpose via a mount of known type in a vehicle headlight or in a light source module for a vehicle headlight.

Accordingly, the term "mounted state" is to be understood to mean a state in which the optical element is installed in accordance with the stated object in a light source module and/or in a vehicle headlight and can be irradiated accordingly by a laser light source. The term "mounted state" also means that terms used hereinafter such as above, below, etc. refer to the installed position of the vehicle headlight unless specified otherwise.

Light irradiation is additionally effectively shielded in the main radiation direction of the vehicle headlight in which the optical element is installed. Besides the provision of the desired light exposure, light from the laser light source, which could radiate past the luminous element or might not be absorbed thereby, is thus shielded by the reflective layer, whereby the endangerment of uninvolved road users is prevented. The reflection layer is impermeable both for visible light and for light in the non-visible range of the spectrum. In the present case, the layer thus reflects both light emitted by the luminous element and light from the laser light source that is not absorbed in the luminous element or that is radiated past the luminous element.

The luminous element is a phosphor converter that is excited by irradiation with laser light to emit visible, preferably white light. Various materials are known and used for this purpose.

In a variant of the invention, the optical element is formed as a solid body made of a substantially transparent, light guiding material and the reflection layer is arranged on the side of the optical element that faces away from the laser light source in the mounted state. By way of example, glass, plastic or other suitable materials can be used as material for the solid body. The reflection layer, which is arranged on the first side of the optical element facing away from the laser light source in the mounted state (that is to say the outer face of the solid body), is formed in such a way that it acts in a reflective manner in the direction of the laser light source.

The reflection layer is to be provided on the outer face on the first side at least in regions, such that the light of the luminous element is returned completely; the reflection layer preferably covers the outer face completely. The layer can be formed in different ways, for example by vapour deposition or painting. The thickness and/or the degree of reflection of the layer are to be selected here such that the light impermeability is ensured both for the laser light and for the visible light emitted by the luminous element.

In a further variant the optical element is formed as a hollow body made of a substantially transparent, light guiding material and the side that faces away from the laser light source in the mounted state is formed by a rear wall, wherein the reflection layer is arranged on the inner side of the rear wall facing the luminous element or on the outer side of the rear wall facing away from the luminous element. The optical element consists here of a sleeve (also made of said transparent light guiding material), which is filled with air or any other gas, wherein attention should be paid to the influence on the refraction properties. The sleeve may also be formed in a number of parts in order to facilitate the manufacture. The layer on the rear wall is again formed by vapour deposition, painting or other suitable methods.

The first side facing away from the laser light source is advantageously formed as a free-form face having at least one focal point, wherein the luminous element can preferably be arranged in a focal point. This is true both for the variant as a solid body and as a hollow body. The receptacle for the luminous element is thus to be formed accordingly, such that the luminous element in the mounted state comes to lie in a focal point of the reflection layer. The light emitted by the luminous element can thus be utilised photometrically in an optimal manner via the reflection layer. Of course, the reflection layer may also comprise a number of focal points, in particular when it is formed as a free-form face. The formation of the first side facing away from the laser light source as a free-form face makes it possible to attain the desired reflection properties when providing a coating with the reflection layer. The efficacy of the system as a whole can thus be increased, since the light of the luminous element radiated in the main radiation direction of the vehicle headlight is not lost, but can be utilised.

In a variant of the invention the reflection region is formed such that reflected light is returned in an annular vicinity around the luminous element. A virtual enlargement of the light source can thus be achieved, which, depending on the planned field of use, may be advantageous for the radiation properties of a vehicle headlight or light source module comprising an optical element according to the invention.

In a third variant, the optical element is formed from a substantially transparent, light guiding material and also has a reflector element attached preferably in a form-fitting manner to the first side of the optical element facing away from the laser light source in the mounted state, said reflector element preferably being made of a light-impermeable material, wherein the reflection layer is arranged on the side of the reflector element facing the luminous element or on the side of the reflector element facing away from the luminous element. The optical element can be formed here as a solid body or as a hollow body according to the above descriptions. Plastic or metal can be used as material. The term "form-fitting" is to be understood here to mean that the form of the reflector element on the side facing the optical element corresponds to the form of the first side of the optical element, and therefore the reflector element rests on the first side without gaps. This form-fitting resting position, however, is not necessary for proper function, and there may also be air gaps or spaces between the reflector element and the first side.

The first side of the optical element facing away from the laser light source and/or the side of the reflector element facing the luminous element and/or the side of the reflector element facing away from the luminous element is favourably formed as a free-form face having at least one focal point, wherein the luminous element preferably can be arranged in a focal point.

At least one light-impermeable absorption layer is advantageously applied to the first side of the optical element facing away from the laser light source in the mounted state, for example to a reflection layer provided there. Depending on whether a reflection layer is applied to the first side (which for example must not be the case in the variant with the reflector element or the hollow body), the absorption layer is applied to the reflection layer or directly to the optical element. The additional provision of the light-impermeable absorption layer has the advantage of reliably preventing light from passing through the reflection layer. The absorption layer can be formed as a layer of paint, for example.

The receptacle for the luminous element is formed as a blind bore or as a cavity surrounded on all sides by the optical element. In the case of the embodiment as a blind bore, for example a new luminous element can be easily inserted or the luminous element can be easily exchanged where necessary. In the case of the embodiment as a completely surrounded cavity, the luminous element is well protected against ambient influences. In the case of wear or the need to exchange the luminous element, the entire optical element is exchanged.

In accordance with a variant of the invention, the second side of the optical element facing the laser light source in the mounted state is formed as a flat delimitation face, preferably running substantially normal to the direction of radiation of the laser light source, and the first side facing away from the laser light source is formed as a free-form face having at least one focal point, wherein the luminous element is preferably arranged in a focal point. The delimitation face may be provided additionally with any surface structure that has light-collecting and/or light-scattering properties. The properties of the light radiated by the delimitation face can thus be influenced.

In a further variant, a connection region is provided in a manner adjoining the delimitation face and connects the second side of the optical element to the first side of the optical element. The connection region is advantageously formed in a manner convergent from the second side of the optical element in the direction of the first side of the optical element. The delimitation face is favourably substantially circular, and the first side of the optical element also has a substantially circular cross section, wherein the first diameter of the first side is greater than the second diameter of the delimitation face. The connection region thus runs in the mounted state in a manner convergent in the direction of the laser light source. Here, the cross section is to be understood to mean a cut along a plane running normal to the direction of radiation of the laser light source. Individual regions of the connection region can be formed differently to the rest, for example with mirrored, transparent or light-impermeable coating, with a surface design for influencing the emitted light, etc.—the exact design is dependent on the use of the optical element.

The optical element according to the invention allows the provision of various light functions. In a variant, especially for dimmed light figures with light/dark boundary, the second side of the optical element facing the laser light source in the mounted state is covered at least in part, but particularly in a region below a horizontal plane running through the luminous element, by a light-impermeable screen device. The screen device is favourably formed as a light-impermeable coating.

In the case of a dipped beam, it is necessary for example for the luminous element to be clearly defined geometrically and photometrically. The above-mentioned screen device is used for this purpose and is formed for example as a painted coating, a coating applied by vapour deposition, or a separate component. The screen device, together with accordingly formed reflection regions, means that the light emission reflected in the optical element exits above the luminous element and can thus be used for the vehicle headlight.

The object of the invention is also achieved in accordance with the invention by a light source module as mentioned in the introduction for a laser vehicle headlight, which comprises at least one laser light source and at least one luminous element which can be irradiated by the laser light source and can thus be excited to emit visible light, in that the luminous element is arranged in an optical element according to one of the above-described variants.

The invention is additionally achieved in accordance with the invention by a vehicle headlight of the type mentioned in the introduction, comprising at least one laser light source and at least one luminous element which can be irradiated by the laser light source and can thus be excited to emit visible light, in that the luminous element is arranged in an optical element as described above. In a variant of the invention, the vehicle headlight has at least one light source module as described previously.

In a variant of the invention, the vehicle headlight has at least one reflector, wherein the optical element is preferably arranged in the vehicle headlight in such a way that the luminous element is positioned in a focal point or in the vicinity of the focal point of the reflector.

Thanks to the invention, various light distribution patterns can be provided depending on application. The invention according to the above embodiments allows the provision of a vehicle headlight that can meet the legal requirements, such as ECE, SAE, CCC, etc.

Figure 2:
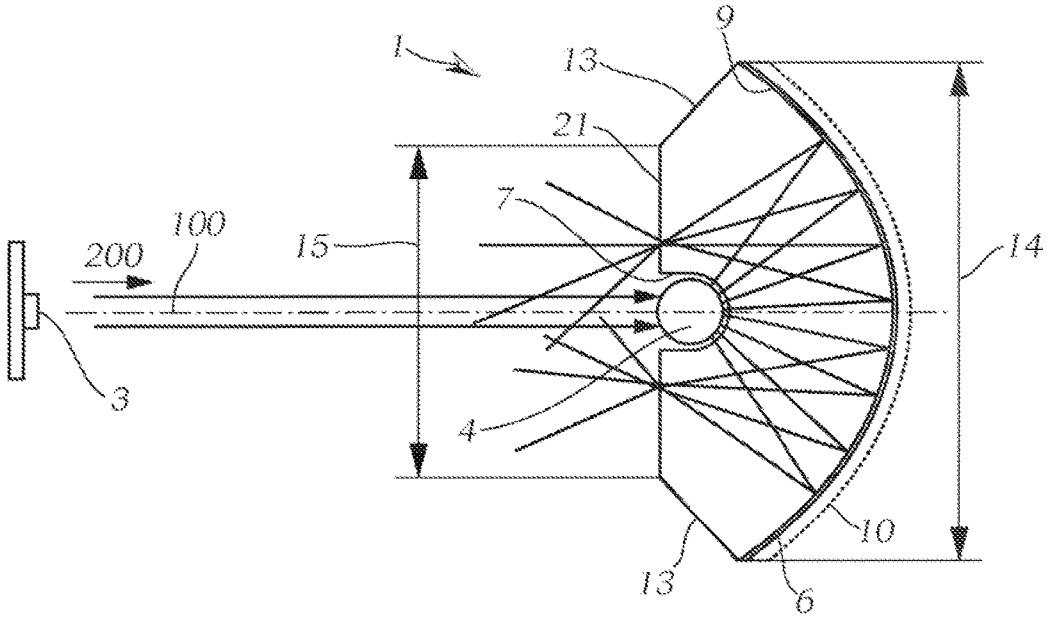
Figure 3:
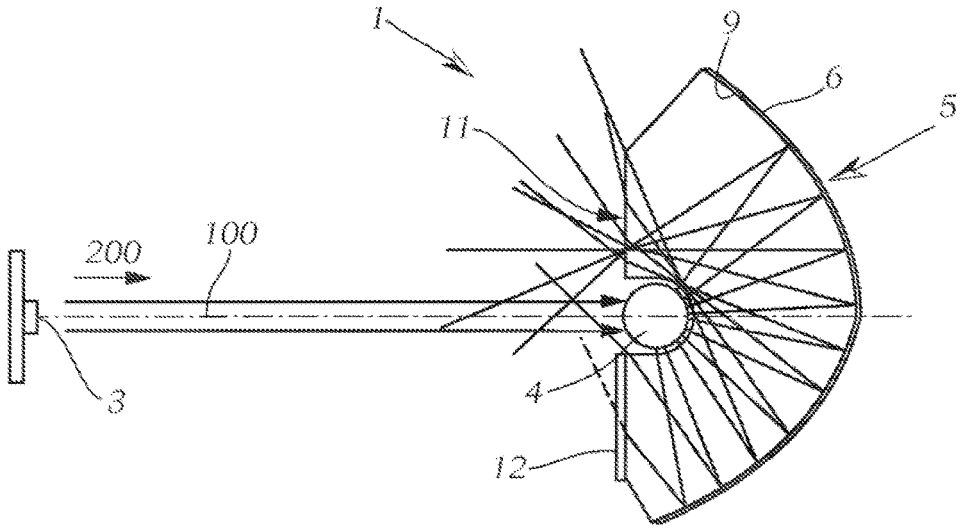
Figure 4:
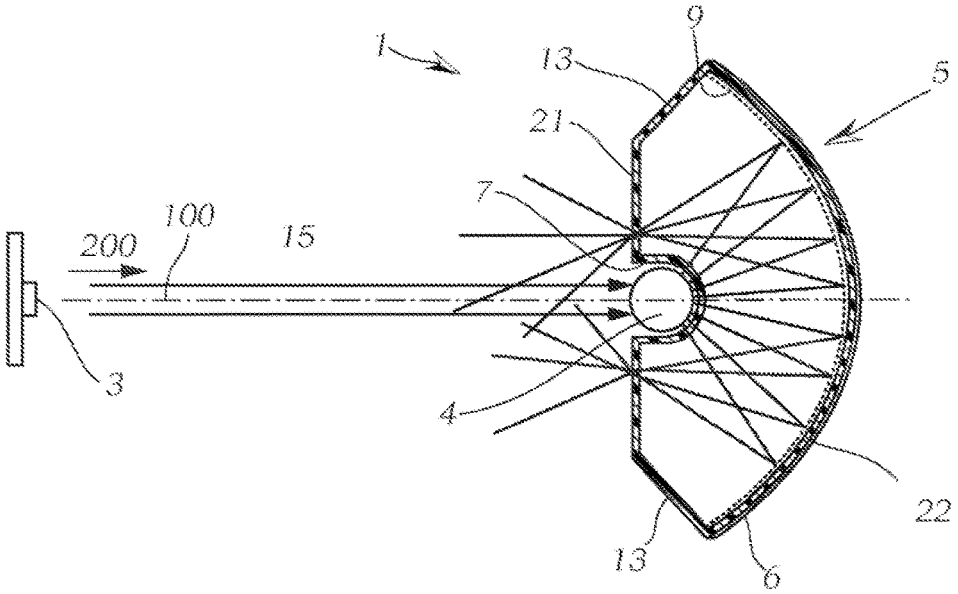
Figure 5:
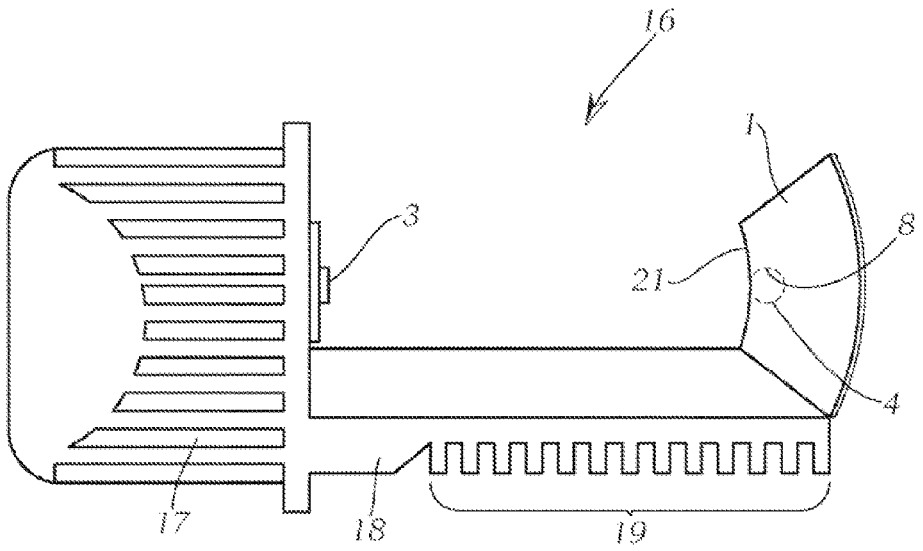
Figure 6:
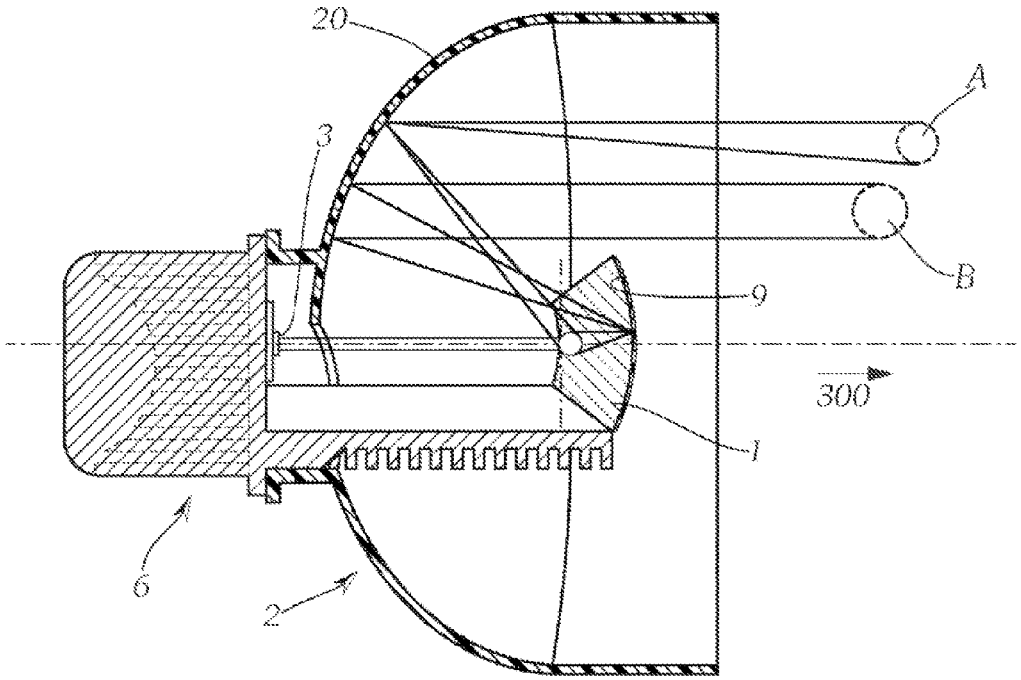

The invention will be explained in greater detail hereinafter on the basis of a non-limiting exemplary embodiment, which is illustrated in the drawing, in which:

FIG. 1 schematically shows a first variant of an optical element according to the invention;

FIG. 2 schematically shows a second variant of an optical element according to the invention;

FIG. 3 schematically shows a third variant of an optical element according to the invention;

FIG. 4 schematically shows a fourth variant of an optical element according to the invention;

FIG. 5 schematically shows a light source module with an optical element according to the invention; and FIG. 6 schematically shows a vehicle headlight with a light source module according to FIG. 5.

For reasons of clarity, like elements in the figures are in each case provided with like reference signs.

FIG. 1 shows a cross-sectional view of a first variant of an optical element 1 for use in a light source module 16 (see FIG. 5) or a laser vehicle headlight 2 (see FIG. 6). The optical element 1 is formed in accordance with this first variant as a solid body made of a transparent, light guiding material, for example glass or plastic.

The optical element 1 has a receptacle, formed as a blind bore 7, for a luminous element 4. The luminous element 4 in this case is a phosphor converter of known type, which is excited by the radiation of monochromatic laser light to emit polychromatic, preferably white light. The luminous element 4 is spherical in the illustrated exemplary embodiment, but can also assume another form (for example ellipsoid form) depending on the field of application of the optical element 1. FIG. 1 additionally illustrates a laser light source 3, which irradiates the luminous element 4 with laser light. The radiation direction 200 is also shown.

A reflection layer 9 is arranged on a first side 5 of the optical element, which faces away from the laser light source 3. The reflection layer 9 is formed here so as to be impermeable both for laser light and for the light emitted by the luminous element 4 and reflects radiated light in the direction of the laser light source 3. The reflection layer 9 can be formed for example by vapour deposition, painting or application of a separate reflection element. The thickness and/or degree of reflection of the reflection layer 9 is to be selected depending on the material used such that both laser light and light emitted by the luminous element 4 is properly reflected and is prevented from penetrating through the reflection layer 9. The reflection layer 9 is necessary since total reflection might not be provided due to the angle at which light radiated by the luminous element impinges.

The visible light emitted by the luminous element 4 along the radiation direction 200 of the laser light source 3 can be utilised photometrically by the reflection layer 9, for example by being guided in the direction of the reflector 20 of a vehicle headlight 2 (see FIG. 6). Accordingly, beam paths that start from the luminous element 4 and are reflected by the reflection layer 9 into the vicinity of the luminous element 4 are illustrated in FIG. 1, whereby a "virtual" enlargement of the light source constituted by the luminous element 4 is produced.

In addition, a further, light-impermeable absorption layer 6 is applied to the reflection layer 9 for safety reasons and absorbs both visible light and non-visible laser light. A layer of this type prevents light from exiting through the reflection layer 9—this may be advantageous when, for example, the reflection layer 9 is produced by vapour deposition: In this case, the layer is only a few micrometers thick and may be too thin in regions (or completely, where possible) or may be incomplete. The additional absorption layer 6 is therefore applied for example as a layer of paint or as a screen.

Depending on the embodiment of the first side 5 of the optical element 1 in combination with the reflection layer 9, various light functions can be provided. For example, the first side 5 of the optical element 1 (that is to say the outer face) can be formed in such a way that it has at least one focal point and the receptacle formed as a blind bore 7 is arranged such that the luminous element 4, when introduced into the receptacle, comes to lie in one of these focal points. To this end, the first side 5 (and therefore also the reflection layer 9) is preferably formed as a free-form face. The embodiment of a free-form face is known to a person skilled in the art.

In a variant, the first side 5 and therefore the reflection layer 9 applied thereto is formed such that light above, below and to the side in the vicinity of the luminous element 4 is reflected and contributes to a virtual enlargement of the light source or of the luminous element 4—the luminous element 4 in this variant is virtually surrounded by a ring of reflected light. The reflection layer 8 thus conducts the light reflected thereby predominantly past the luminous element. This variant is illustrated in FIG. 1.

The optical element 1 according to FIG. 1 corresponds slightly in terms of form to a sphere segment. The second side 11 of the optical element 1 facing the laser light source 3 in the mounted state is formed as a flat delimitation face 21 preferably running substantially normal to the radiation direction 200 of the laser light source 3. The first side 5 of the optical element facing away from the laser light source 3, as already mentioned, is formed as a free-form face with at least one focal point, wherein the luminous element 4 can preferably be arranged in a focal point. Said free-form face corresponds slightly to a spherical dome or a spherical cap, wherein, due to the reflection characteristics, it is discernible that it does not actually have such a form. In principle, a reverse design or arrangement is also possible, that is to say the delimitation face 21 is thus arranged in a manner facing away from the laser light source 3. The delimitation face 21 does not have to be formed as a flat face, but can also assume another form, for example it can be concave, convex or also formed with an undulating surface in order to additionally influence the beam path.

FIG. 2 shows a variant of the optical element 1 according to the invention, in which a connection region 13 is provided between the delimitation face 21 and the first side 5 of the optical element. The connection region 13 connects the first side 5, which faces away from the laser light source 3 in the mounted state, to the delimitation face 21 on the second side 11 facing the laser light source 3. The connection region 13 can also be provided with a coating, for example with a light-impermeable, absorbing layer or also with a reflective layer, wherein the layer can act in a reflective manner either in the direction of the optical element interior or also outwardly. The connection region 13 and also the delimitation face 21 may be provided additionally with any surface structure that has light-collecting and/or light-scattering properties. In principle, the individual surface regions of the optical element 1 may thus be different, for example with light-impermeable and/or reflective coatings or surface structures that refract or influence the emerging light. These variants, however, are not illustrated in the figures.

The connection region 13 is formed in the illustrated exemplary embodiment in a manner convergent in the direction of the laser light source 3. To this end, the delimitation face 21 is substantially circular for example, and the first side 5 of the optical element 1 also has a substantially circular cross section. Here, the cross section runs in a plane arranged normal to the radiation direction 200 of the laser light source 3—that is to say normal to the drawing plane and to the radiation direction 200 in the present figures. The first diameter 14 of the first side 5 is greater than the second diameter 15 of the delimitation face 21, and therefore the convergent form is provided. Of course, a reverse embodiment is also possible here.

In a second variant of the invention, which is shown in FIG. 2 by dashed lines, the reflection layer 9 is applied to a reflector element 10, which is applied to the first side 5 of the optical element 1. The reflection layer 9 can be applied here on the side of the reflector element 10 facing the optical element 1. The reflector element 10 preferably consists of a light-impermeable or light-absorbing material, for example plastic or metal (for example sheet metal). Of course, the reflector element 10 can also be manufactured from a light-permeable material and the reflection layer 9 can be applied on the side facing away from the optical element 1. In this case, however, it would also be favourable to apply a light-impermeable layer to the reflection layer 9 in order to prevent light from passing through the reflection layer and interfering with the light exposure or endangering uninvolved road users.

The reflector element 10 is preferably formed such that it adjoins the first side 5 of the optical element 10 in a form-fitting manner. Similarly to the first described variant, the reflection layer 9 has at least one focal point due to the form of the reflector element 10, wherein the luminous element 4 in the mounted state is preferably arranged in a focal point of the reflection layer 9. The optical element 1 and/or reflector element 10 are to be formed accordingly as free-form faces of known type.

FIG. 3 shows a variant of the invention in which the optical element 1 has on its second side 11 (that is to say the side facing the laser light source 3 in the mounted state) a light-impermeable screen device 12. This screen device 12 covers the second side 11 at least in part, wherein it is arranged in the illustrated exemplary embodiment beneath a horizontal plane 100 running through the luminous element 4. The horizontal plane 100 in the figures runs normal to the drawing plane and is therefore identifiable merely as a dot-and-dash line. Of course, other embodiments are also possible depending on the desired light function.

The screen device 12 can be formed arbitrarily, for example as a light-impermeable coating or as a separate screen, which is glued to the optical element 1 or fitted thereto in another way or is mechanically held thereon. The screen device 12 allows the generation of a light/dark transition, whereby various light functions, such as dipped beam, fog light, etc., can be provided.

In the variant according to FIG. 3, the form of the first side 5 facing away from the laser light source 3 is different from the embodiment in FIGS. 1 and 2. Here, the form is no longer similar to a spherical cap, but is different, which is discernible on the basis of the sketched beam paths.

It should be noted that the optical element 1, besides the integral embodiment illustrated here (apart from coatings or screen elements or the like), can also be formed in variants such that it consists of a number of parts, which for example are glued together or welded together and have different optical properties (refractive index or the like). With such a multi-part optical element 1, the solid body would thus be formed in a number of parts for example, wherein the separate components can be manufactured with different optical properties. Accordingly, the reflection layer 9 (or the absorption layer 6) can then also be introduced as separate components.

A variant that is formed favourably with such a multi-piece element is illustrated in FIG. 4. In this case the optical element 1 is formed as a hollow body. It thus has a sleeve, which preferably predominantly consists of a transparent, light guiding material. The reflection layer 9 is formed on the rear wall 22, which is arranged on the first side 5. The reflection layer 9 is formed in the illustrated exemplary embodiment on the inner side of the rear wall 22 facing the luminous element 4. An absorption layer 6 is applied to the outer side of the rear wall 22 facing away from the luminous element 4 in order to prevent laser light or light emitted by the luminous element 4 from passing through the rear wall 22. Of course, this is just one of a number of embodiments—for example the reflection layer 9 can be applied to the outer side of the rear wall 22 and also covered by an absorption layer 6.

The screen device 12 described further above can also be provided in variants with a hollow body besides the described embodiments by manufacturing the hollow body from a thermo-plastic. In this case, the region of the delimitation face 21 constituting the screen device 12 (preferably beneath a horizontal plane 100 running through the luminous element 4) is sprayed with a light-impermeable material in a multi-component spraying method. No further measures than have to be taken in order to provide a screen device 12.

In accordance with the variant of FIG. 4, the optical element can be formed in a number of pieces, for example by forming the rear wall 22 and the rest of the optical element 1 separately. In such a case the rear wall can be manufactured for example from a light-impermeable material, whereby the absorbing layer 6 can be saved when the reflection layer 9 is arranged on the inner side of the rear wall 22. Whereas the rear wall 22 thus constitutes a reflector, the rest of the optical element 1 substantially forms a cover for this reflector with a mount for the luminous element 4. Of course, however, the rear wall 22 and the rest of the optical element 1 can also form a common structural unit.

Ambient air is usually located within the hollow body, which does not have to be gas-tight. Of course, the hollow body can also be gas-tight, such that the interior can be filled with other gases, which for example influence the reflection behaviour.

The variants described in FIGS. 1 to 3 can be provided both with a solid body and with a hollow body.

FIG. 5 shows a variant of the invention in which the optical element 1 is installed in a light source module 16 for a vehicle headlight 2. The optical element 1 according to this embodiment has a receptacle for the luminous element 4 in the form of a cavity 8. This means that the luminous element 4 is surrounded completely by the optical element 1. The delimitation face 21 (or first side 11) is slightly concave in the variant according to FIG. 5.

The light source module 16 has a laser light source 3 inclusive of assigned cooling devices 17 (for example cooling ribs, water cooling or the like), wherein the laser light source 3 and the optical element 1 are arranged jointly on a carrier element 18. The carrier element 18 can consist of a heat-conductive material and/or additional cooling elements, such as cooling ribs 19.

The light source module 16 as a whole can be installed in a vehicle headlight 2. Such a variant is illustrated in FIG. 6. Here, it can be seen that, thanks to the reflection layer 9 of the optical element 1, a utilisation of the light radiated by the luminous element 4 in the main radiation direction 300 of the laser vehicle headlight 2 is made possible, since this light is guided by the reflection layer 9 in the direction of the reflector 20 of the vehicle headlight 2. Furthermore, it can be seen that light emitted directly by the luminous element 4 is projected differently (projection A in FIG. 6) from light that reaches the reflector 20 of the vehicle headlight 2 via the reflection element 10 (projection B in FIG. 6).

The optical element 1 is favourably arranged in the vehicle headlight 2 in such a way that the luminous element 4 is positioned in a focal point of the reflector 20. Due to the combination of the shaping of the reflector 20 and of the optical element 1, different light distribution patterns can be provided. Theoretically, the light patterns of the light emitted directly by the luminous element 4 can also be aligned with the light pattern of the light radiated via the reflection element 10.

The invention claimed is:

1. An optical element (1) for a laser vehicle headlight (2), wherein the laser vehicle headlight (2) comprises at least one laser light source (3) and at least one luminous element (4) which is configured to be irradiated by the laser light source (3) and thus excited to emit visible light, the optical element (1) comprising:

at least one receptacle for the luminous element (4); and at least one reflection layer (9) which reflects light in the direction of the laser light source (3), wherein the at least one reflection layer (9) is assigned to the optical element (1) at least on a side of the luminous element (4) which faces away from the laser light source (3) in a mounted state, wherein (i) the optical element (1) is formed as a solid body made of a substantially transparent, light guiding material, and the reflection layer (9) is arranged on a first side (5) of the optical element (1) facing away from the laser light source (3) in the mounted state, or (ii) the optical element (1) is formed as a hollow body made of a substantially transparent, light guiding material and is formed on a side of a rear wall (22) facing away from the laser light source (3) in the mounted state, the reflection layer (9) being arranged either on an inner side of the rear wall (22) facing the luminous element (4) or on an outer side of the rear wall (22) facing away from the luminous element (4), and wherein the first side (5) facing away from the laser light source (3) is formed as a free-form face having at least one focal point, and the receptacle for receiving the at least one luminous element is arranged in a focal point of the reflection layer (9).

2. The optical element (1) according to claim 1, wherein the optical element has a reflector element (10) applied to the first side (5) of the optical element (1) facing away from the laser light source (3) in the mounted state, wherein the reflection layer (9) is arranged on a side of the reflector element (10) facing the luminous element (4) or on a side of the reflector element (10) facing away from the luminous element (4).

3. The optical element (1) according to claim 2, wherein the first side (5) of the optical element facing away from the laser light source (3) and/or the side of the reflector element (10) facing the luminous element (4) and/or the side of the reflector element (10) facing away from the luminous element (4) is/are formed as a free-form face having at least one focal point.

4. The optical element according to claim 3, wherein the luminous element is arranged in a focal point.

5. The optical element according to claim 2, wherein the reflector element is made of a light-impermeable material.

6. The optical element according to claim 5, wherein the reflector element is applied in a form fitting manner to the first side.

7. The optical element (1) according to claim 1, wherein at least one light-impermeable absorption layer (6) is applied to the first side (5) of the optical element (1) facing away from the laser light source (3) in the mounted state.

8. The optical element according to claim 7, wherein the at least one light-impermeable absorption layer is applied to a reflection layer provided on the first side of the optical element.

9. The optical element (1) according to claim 1, wherein the at least one receptacle for the luminous element (4) is formed as a blind bore (7) or as a cavity (8) surrounded on all sides by the optical element (1).

10. The optical element (1) according to claim 1, wherein a second side (11) of the optical element (1) facing the laser light source (3) in the mounted state is formed as a flat delimitation face (21).

11. The optical element (1) according to claim 10, wherein a connection region (13) is provided in a manner adjoining the delimitation face (21) and connects the second side (11) of the optical element (1) to the first side (5) of the optical element (1).

12. The optical element (1) according to claim 11, wherein the connection region (13) is formed in a manner convergent from the second side (11) of the optical element (1) in the direction of the first side (5) of the optical element (1).

13. The optical element (1) according to claim 10, wherein the delimitation face (21) is substantially circular and the first side (5) of the optical element (1) likewise has a substantially circular cross section, wherein the diameter (14) of the first side (5) is greater than the diameter (15) of the delimitation face (21).

14. The optical element according to claim 10, wherein the delamination face runs substantially normal to the radiation direction of the laser light source.

15. The optical element (1) according to claim 1, wherein a second side (11) of the optical element (1) facing the laser light source (3) in the mounted state is covered at least in part by a light-impermeable screen device (12).

16. The optical element (1) according to claim 15, wherein the light-impermeable screen device (12) is formed as a light-impermeable coating.

17. The optical element according to claim 15, wherein the light-impermeable screen device covers the second side in a region below a horizontal plane running through the luminous element.

18. A light source module (16) for a laser vehicle headlight (2), wherein the laser vehicle headlight (2) comprises at least one laser light source (3) and at least one luminous element (4) which is configured to be irradiated by the laser light source (3) and thus excited to emit visible light, the light source module (16) comprising:

an optical element (1) comprising:

at least one receptacle for the luminous element (4); and at least one reflection layer (9) which reflects light in the direction of the laser light source (3), wherein the at least one reflection layer (9) is assigned to the optical element (1) at least on a side of the luminous element (4) which faces away from the laser light source (3) in a mounted state, wherein (i) the optical element (1) is formed as a solid body made of a substantially transparent, light guiding material, and the reflection layer (9) is arranged on a first side (5) of the optical element (1) facing away from the laser light source (3) in the mounted state, or (ii) the optical element (1) is formed as a hollow body made of a substantially transparent, light guiding material and is formed on a side of a rear wall (22) facing away from the laser light source (3) in the mounted state, the reflection layer (9) being arranged either on an inner side of the rear wall (22) facing the luminous element (4) or on an outer side of the rear wall (22) facing away from the luminous element (4), wherein the first side (5) facing away from the laser light source (3) is formed as a free-form face having at least one focal point, and the receptacle for receiving the at least one luminous element is arranged in a focal point of the reflection layer (9), and wherein the luminous element (4) is arranged in the optical element (1).

19. A vehicle headlight (2) which comprises the at least one light source module (16) according to claim 18.

20. A vehicle headlight, (2) comprising:

at least one laser light source (3);

at least one luminous element (4) which is configured to be irradiated by the laser light source (3) and thus excited to emit visible light; and an optical element (1) comprising:

at least one receptacle for the luminous element (4); and at least one reflection layer (9) which reflects light in the direction of the laser light source (3), wherein the at least one reflection layer (9) is assigned to the optical element (1) at least on a side of the luminous element (4) which faces away from the laser light source (3) in a mounted state, wherein (i) the optical element (1) is formed as a solid body made of a substantially transparent, light guiding material, and the reflection layer (9) is arranged on a first side (5) of the optical element (1) facing away from the laser light source (3) in the mounted state, or (ii) the optical element (1) is formed as a hollow body made of a substantially transparent, light guiding material and is formed on a side of a rear wall (22) facing away from the laser light source (3) in the mounted state, the reflection layer (9) being arranged either on an inner side of the rear wall (22) facing the luminous element (4) or on an outer side of the rear wall (22) facing away from the luminous element (4), wherein the first side (5) facing away from the laser light source (3) is formed as a free-form face having at least one focal point, and the receptacle for receiving the at least one luminous element is arranged in a focal point of the reflection layer (9), and wherein the luminous element (4) is arranged in the optical element (1).

21. The vehicle headlight (2) according to claim 20, wherein the vehicle headlight (2) has at least one reflector (20) and the optical element (1) is arranged in the vehicle headlight (2) in such a way that the luminous element (4) is positioned in a focal point or in the vicinity of the focal point of the reflector (20).

* * * * *